US005241789A

United States Patent [19]

Vacelet

[11] Patent Number: 5,241,789

[45] Date of Patent: Sep. 7, 1993

[54] APPARATUS FOR PROTECTING ELEVATOR SHAFT OPENINGS DURING SHAFT DOOR ASSEMBLY

[75] Inventor: Jean Vacelet, Le Pecq, France

[73] Assignee: Inventio AG, Hergiswil, Switzerland

[21] Appl. No.: 875,992

[22] Filed: Apr. 29, 1992

[30] Foreign Application Priority Data

May 2, 1991 [CH] Switzerland ..... 01313/91

[51] Int. Cl.[5] ..... E05D 15/28

[52] U.S. Cl. ..... 49/248; 49/50; 49/55

[58] Field of Search ..... 49/55, 57, 50, 61, 63, 49/246, 248, 249; 52/37, 208; 256/59, 67; 182/113

[56] References Cited

U.S. PATENT DOCUMENTS

| | | | |
|---|---|---|---|
| 1,511,260 | 10/1924 | Brousseau | 52/37 |
| 1,745,661 | 2/1930 | Dittrich | 52/37 X |
| 1,873,229 | 8/1932 | Van Dresser | 49/55 |
| 2,780,458 | 2/1957 | Thaxton | 49/63 |
| 3,155,423 | 11/1964 | Cripe | 49/249 X |
| 3,425,165 | 2/1967 | Cleveland . | |
| 3,901,481 | 8/1975 | Probst | 256/59 |
| 4,437,265 | 3/1984 | Turro et al. | 49/57 |
| 4,510,714 | 4/1985 | Kasper et al. | 49/249 |
| 4,635,905 | 1/1987 | Fontana | 256/59 X |
| 4,909,483 | 3/1990 | van Herpen | 256/59 |
| 4,979,725 | 12/1990 | Hutchings, II et al. | 256/67 X |

FOREIGN PATENT DOCUMENTS

| | | | |
|---|---|---|---|
| 1000428 | 12/1988 | Belgium . | |
| 0288100 | 11/1998 | European Pat. Off. . | |
| 3015284 | 1/1982 | Fed. Rep. of Germany | 49/248 |
| 3923691 | 5/1990 | Fed. Rep. of Germany . | |

*Primary Examiner*—Peter M. Cuomo
*Assistant Examiner*—Jerry Redman
*Attorney, Agent, or Firm*—Wiliam J. Clemens

[57] ABSTRACT

A protective railing assembly for an elevator shaft door opening includes a railing which is secured to the floor at the shaft door opening by two hinged parallelogram linkages. The protective railing can be moved between two different horizontally spaced positions and thus be displaced through a predetermined distance without being removed from the shaft door opening. The railing can be mounted while the shaft door opening is still barricaded to permit the barricading to be removed and a shaft door mounted. The railing provides a continuous protection against the falling of persons into the shaft during the shaft door assembly. The protective railing is extensible for adaptation to different opening widths and the parallelogram linkages are maintained at a constant spacing one from the other to permit installation in openings of different widths.

12 Claims, 3 Drawing Sheets

APPARATUS FOR PROTECTING ELEVATOR SHAFT OPENINGS DURING SHAFT DOOR ASSEMBLY

BACKGROUND OF THE INVENTION

The present invention relates generally to elevators and, in particular, to an apparatus for protecting elevator shaft openings during assembly of the shaft doors.

During the erection of an elevator installation, the assembly and alignment of the shaft doors is particularly connected with an appreciable risk of accident. The barriers, which are mounted in the shaft openings of the floors in the building after the carcase work is completed, must be removed for the installation of the shaft doors and fronts. The assembly personnel therefore work for a certain time at the open shaft opening and must protect themselves by means of prescribed safety items, such as a safety belt and rope, against accidents. The danger of the possible falling into the shaft is not, however, eliminated thereby, because falling into the shaft in the roped-on state can still cause severe injuries.

A railing, which is clampable into the shaft door opening and which due to a simple clamping device can be mounted and disassembled rapidly, is described in the U.S. Pat. No. 3,425,165. In the mounted state, the protection against falling-in is assured, because those parts which project laterally beyond the shaft opening, above and below, prevent a pushing-in of small objects during cleaning operations on the floor. The railing can be used for different door opening widths in a certain range by means of the clamping device in the form of an upper transverse tube which is expandable against spring force in the manner of a telescope.

The somewhat contradictory requirement that the door opening shall not be barricaded during the working process of the door installation can not be fulfilled by the above-described railing because the protective railing must be removed temporarily for better access for fastening operations at the inward shaft wall adjoining the shaft opening. Thus, the dangers of accident for the elevator installation personnel are still appreciable. Furthermore, the clampable railing can be used only when the barrier previously mounted on the building side has been removed.

SUMMARY OF THE INVENTION

The present invention concerns an apparatus for protecting the elevator shaft door opening, which apparatus remains fully effective during the entire assembly process of the shaft door installation. The protective apparatus for the shaft door opening is in the form of a mountable railing which, during the assembly time of the door, secures the still open access to the shaft against persons falling in. The protective railing assembly includes a railing, a pair of parallelogram linkages attached to the railing at spaced apart first pivot point, and means for attaching the linkages to a threshold of an elevator shaft door opening at a pair of second pivot points spaced from the first pivot points. The railing is movable between two positions separated horizontally in a direction to and from an associated elevator shaft by twice the amount of spacing between each first pivot point and an associated one of the second pivot points.

The railing includes a pair of railing feet, each of the linkages being pivotally attached to an associated one of the feet at the first pivot point, the feet being spaced apart a predetermined distance less than a width of the narrowest standard elevator shaft opening for attachment to thresholds of different door opening widths. The parallelogram linkages pivot about the first pivot point and the second pivot point through an angle of at least 180°. The railing can include an adjusting device for selectively varying a width of the railing to correspond to a desired door opening width.

Each parallelogram linkage includes a pair of generally horizontally extending, vertically spaced apart links each extending between the first pivot point and the second pivot point, and a distance between the first pivot point and the second pivot point on each of the links is greater than a vertical distance between the links. The assembly also can include a pair of arms attached to the railing and each having a free end extending generally horizontally, a pair of generally vertically extending supports each having a lower end for attachment to the threshold of the shaft door opening and an upper end, and a pair of hinge links each pivotally connected between the free end of one of the arms and the upper end of one of the supports whereby the railing is stabilized in all positions of a pivotal movement between the two positions.

The advantages achieved by the invention are that the railing assembly can be left in the mounted and effective state during all preparatory and assembly operations. Through displacement of the protective railing in the direction of the shaft, operations at the inward shaft wall adjoining the shaft opening can be carried out free of danger.

A further advantage lies in the fact that the railing assembly does not have to be removed during the displacement between the two positions thus providing constant protection of the shaft opening.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
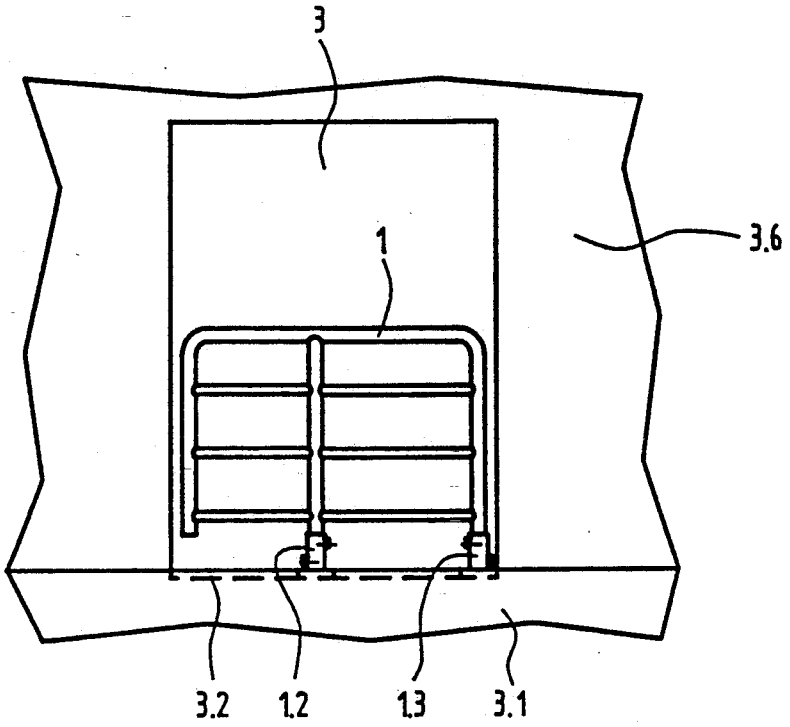
FIG. 1 is a front elevation of a protective apparatus according to the present invention.
Figure 2:
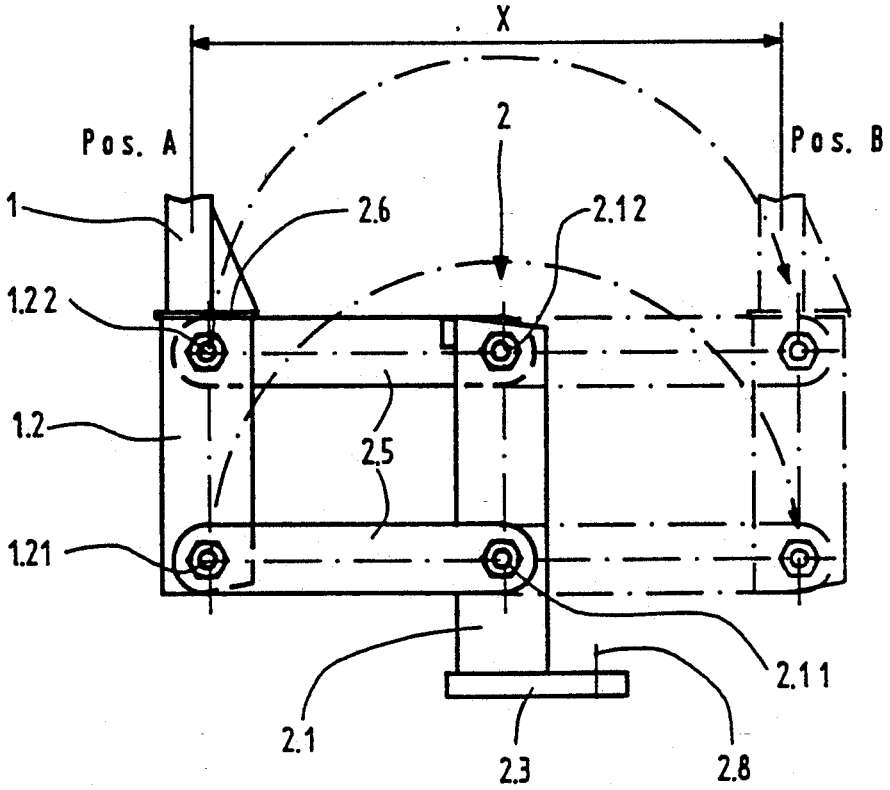
FIG. 2 is an enlarged, fragmentary side elevation view of the pivot mechanism shown in the FIG. 1.

The FIG. 1 shows an elevator shaft door opening 3 formed in a front wall 3.6 and a floor 3.1 of a building. The lower half of the shaft door opening 3 is covered by a protective railing 1 against entry into the shaft 3. The protective railing 1 is fastened at the floor 3.1 in a threshold recess 3.2 formed in the floor. The railing 1 includes a left-hand railing foot 1.2 and a right-hand railing foot 1.3. A hinged parallelogram linkage 2, which is shown in the FIG. 2, includes a portion of the generally vertically extending left-hand railing foot 1.2 connected to one end of each of a pair of pivotable, generally horizontally extending, parallelly arranged links 2.5. At the opposite ends, the links are pivotally connected to a generally vertically extending left-hand bearing support 2.1. The bearing support 2.1 has a lower end attached, such as by welding, to a generally horizontal base plate 2.3. The base plate 2.3 is bent over laterally in a short leg for stiffening and on the right-hand side thereof has a vertical aperture 2.8 formed therein for receiving a fastening screw which is not shown. The links 2.5 are rotatably retained on the railing foot 1.2 at vertically spaced first pivot points by a lower bearing 1.21 and an upper bearing 1.22 and on the support 2.1 at vertically spaced second pivot points by a lower bearing 2.11 and an upper bearing 2.12.

In a first position, Pos. A, which is drawn in solid lines, the protective railing 1 is pivoted in the direction of the shaft opening 3 and is retained in this position by an abutment plate 2.6. The plate 2.6 extends generally horizontally from an upper end of the foot 1.2 and abuts a left-hand end of an upper edge of the upper one of the links 2.5. In a second position, Pos. B, which is drawn in dashed lines the railing 1 is pivoted through 180° to the right in the direction of the floor 3.1. In the position Pos. B, the railing is again retained by means of the abutment plate 2.6 and the upper link 2.5. The pivotal movement takes place along the circular arcs drawn in dashed lines and effects an horizontal displacement of the protective railing 1 by a distance X. The distance X corresponds to twice the distance between the pivot points along the longitudinal axis of the links 2.5. The lower one of the links 2.5 is mounted on one side and the upper one of the links 2.5 is mounted on the other side of the base plate 2.3 and the railing foot 1.2, whereby the collision-free 180° movement of the hinged parallelogram is possible. A similar second hinged parallelogram (not shown) includes the railing foot 1.3.

Figure 3:
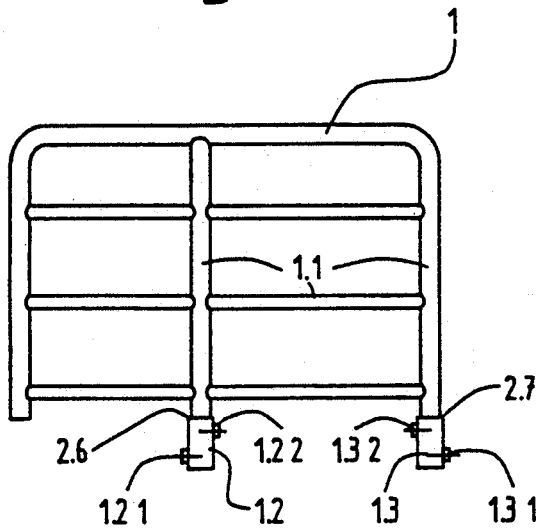
FIG. 3 is a front elevation view of the railing shown in the FIG. 1.
Figure 4:
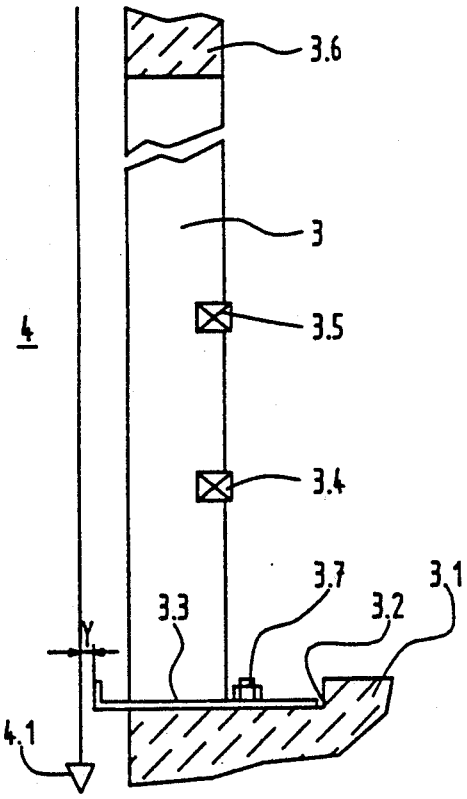
FIG. 4 is an enlarged cross-sectional view of the elevator shaft opening shown in the FIG. 1 during the first phase of the shaft door installation.

The FIG. 3 shows a front elevation of the protective railing 1, which is for example built as welded construction with a plurality of corresponding vertically and horizontally arranged tubes 1.1. The railing feet 1.2 and 1.3 are attached, as by welding, to the abutment plate 2.6 and an abutment plate 2.7 respectively, and to each lower end of a right-hand one and a central one of the vertical tubes 1.1. The links 2.5 are rotatably retained on the railing foot 1.2 by the lower bearing 1.21 and the upper bearing 1.22 and a similar pair of links (not shown) are rotatably retained on the railing foot 1.3 by a lower bearing 1.31 and an upper bearing 1.32. The function of the protective equipment is illustrated in five sequential steps by the FIGS. 4 through 8. In the FIG. 4, the shaft door opening 3 to an elevator shaft 4 is barricaded provisionally at the building side by a lower crossbeam 3.4 and an upper crossbeam 3.5. In a first step, a door support 3.3 in the form of a metal profile plate, which is bent over upwardly in a short leg at the shaft side, is mounted in the threshold recess 3.2, which mounting could take place without the removal of the crossbeams 3.4 and 3.5. The door support 3.3 is fastened in the recess 3.2 by screw bolts 3.7 temporarily anchored to the floor 3.1. An auxiliary plumb bob 4.1 designates the center of the door element to be installed. A distance Y is maintained between the plumb bob line and the vertical leg of the door support 3.3.

Figure 5:
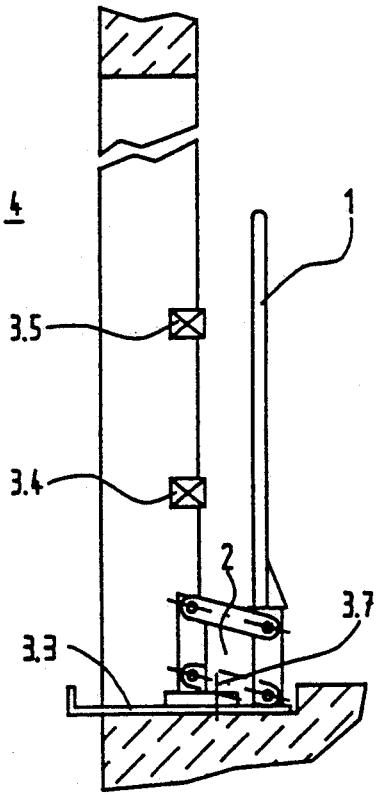
FIG. 5 is an enlarged cross-sectional view similar to the FIG. 4 during the second phase of the door installation.

In the FIG. 5, the protective railing 1 is mounted in a second step at the base of the threshold recess 3.2 by the base plates 2.3 and 2.4 with the apertures 2.8 and the cooperating screw bolts 3.7. The railing 1 also could be mounted by quick release fasteners (not shown) on the door support 3.3. The crossbeams 3.4 and 3.5, which have until now barricaded the shaft door opening 3, can be removed after this fastening operation. The hinged parallelogram 2 is pivoted to the right hand side in the direction of the floor 3.1 and thus does not collide with the still inserted crossbeams 3.4 and 3.5.

Figure 6:
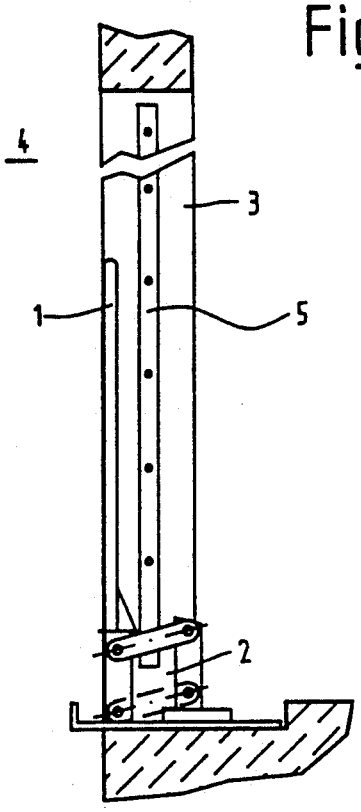
FIG. 6 is an enlarged cross-sectional view similar to the FIG. 4 during the third phase of the door installation.
Figure 6:
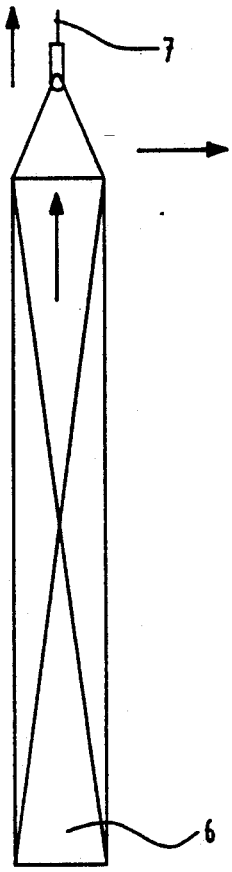

During the next step according to the FIG. 6, the hinged parallelogram linkage 2 is pivoted to the left-hand side in the direction of the shaft 4 and the protective railing 1 frees the lateral inward side of the shaft door opening 3 for the assembly of a door-fastening profile 5. If required, further preparatory operations and/or assembly operations at the inward shaft wall directly adjoining the shaft door opening can be carried out without danger through slight leaning into the shaft 3 with this position of the protective railing 1.

Figure 7:
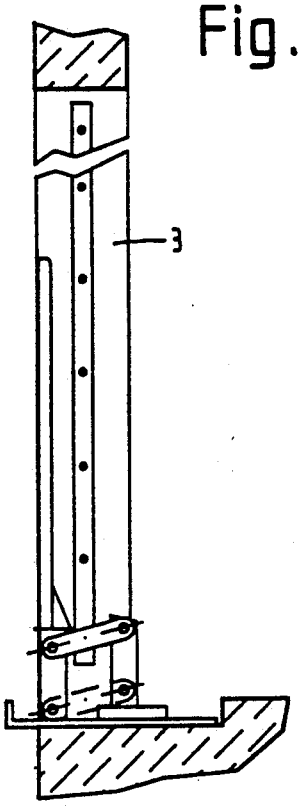
FIG. 7 is an enlarged cross-sectional view similar to the FIG. 4 during the fourth phase of the door installation.

According to the FIG. 7, in a fourth step, a shaft door subassembly 6 is now brought to the actual shaft door opening 3 by a hoist 7. Through rotation of the hinged parallelogram linkage 2 to the floor side of the opening 3, according to a fifth step shown in the FIG. 8, the shaft door subassembly 6 can be set at the prepared place adjacent to the profile 5 and fastened there. As soon as the shaft door is closed, the protective railing 1 can be removed. Thus, protection against the falling of persons into the elevator shaft was present without interruption during the entire shaft door assembly. Through the hinged parallelogram linkage 2, it is possible to set the protective railing 1, without removal, to two different positions which serve to provide the required accessibility for the performance of different installation operations.

Figure 9:
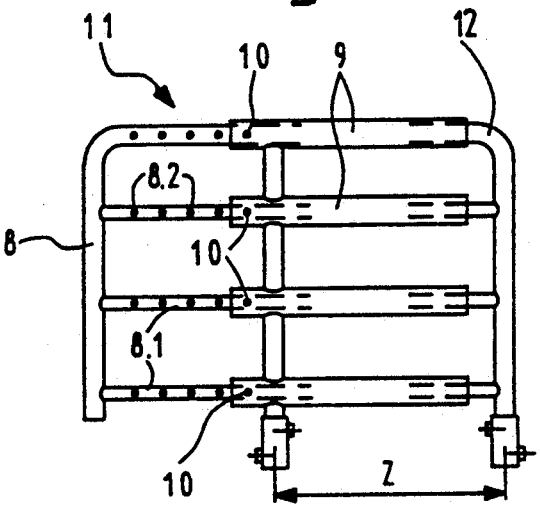
FIG. 9 is a front elevation view of a first alternate embodiment of the railing shown in the FIG. 1.

In a further developed form, a first alternate embodiment protective railing 12 according to FIG. 9 includes an adjusting device 11, by which the protective railing 12 can be adapted to different opening widths. A separate left-hand portion 8 of the railing 12 has a plurality of smaller diameter horizontal tubes 8.1. Each of the tubes 8.1 has a plurality of transverse apertures 8.2 formed therein at regular spacings. The tubes 8.1 can be pushed into corresponding horizontal tubes 9 of the right-hand portion of the railing 12 and retained to form the desired width of railing by means of not illustrated safety pins, which pins extend through the apertures 8.2 and a plurality of corresponding transverse apertures 10 formed in the tubes 9 and are secured therein.

Figure 10:
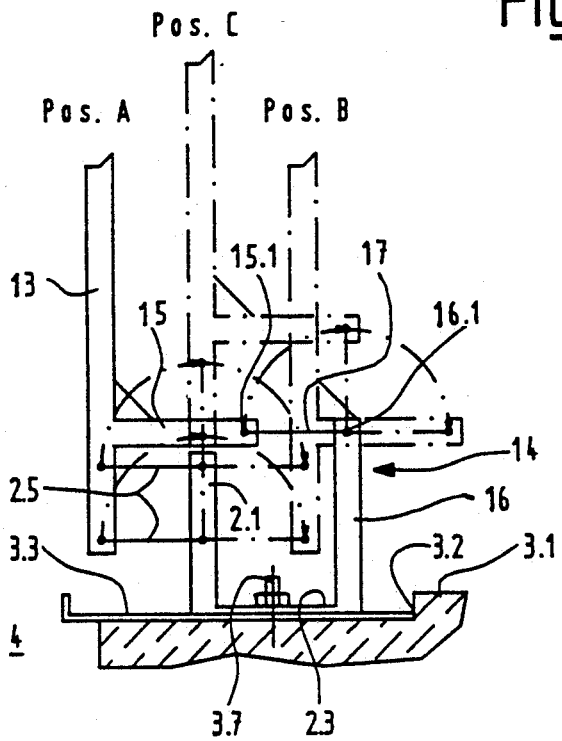
FIG. 10 is a fragmentary side elevation view of a second alternate embodiment of the railing shown in the FIG. 1.
Figure 8:
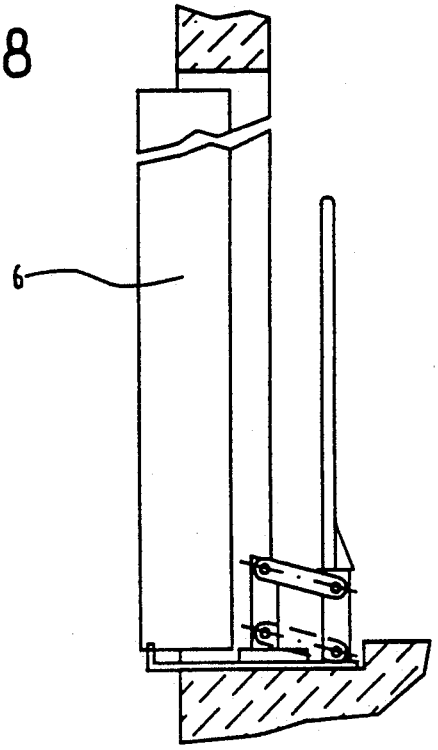
FIG. 8 is an enlarged cross-sectional view similar to the FIG. 4 during the fifth phase of the door installation.

A second alternate embodiment railing 13 is shown in schematic illustration according to the FIG. 10. The railing 13 has an additional joint 11, which joint consists of an arm 10 which projects horizontally to the right from the protective railing 13 and which at its right-hand end has a bearing 15.1. A generally vertically extending support 16 has a lower end attached to the base plate 2.3 and has a bearing 16.1 at its upper end.

The support 16 is spaced from the support 2.1 and a hinge link 17 is connected between the bearings 15.1 and 16.1. When the parallelogram hinge links 2.5 are disposed in vertical setting third position (Pos. C) during the pivotal movement of the protective railing 13, an additional stabilization is achieved by this arrangement.

Both the railing feet 1.2 and 1.3 have the same predetermined spacing Z (FIG. 9) one from the other for all railing constructions. This has the purpose that the apertures for receiving the screw bolts 3.7 in the threshold recess 3.2 for all opening widths can also be drilled at the same spacing Z and accordingly also with one and the same drill template.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A protective apparatus for a shaft door opening of an elevator shaft which, until a shaft door is installed in the shaft door opening, secures the shaft door opening against a falling of persons into the shaft comprising: a railing; at least one parallelogram linkage attached to said railing at a first pivot point; and means for attaching said linkage to a threshold of an elevator shaft door opening at a second pivot point spaced from said first pivot point whereby said railing is movable between two positions horizontally spaced, a first one of said positions being closer to the shaft door opening than a second one of said positions by twice an amount of spacing between said first pivot point and said second pivot point.

2. The protective apparatus according to claim 1 including a pair of said parallelogram linkages and wherein said railing includes a pair of failing feet, each of said linkages being pivotally attached to an associated one of said feet at said first pivot point, said feet being spaced apart a predetermined distance less than a width of a narrowest standard elevator shaft opening for attachment to thresholds of different opening widths.

3. The protective apparatus according to claim 1 wherein said railing includes an adjusting device for selectively varying a width of said railing to correspond to a desired door opening width.

4. The protective apparatus according to claim 1 wherein said parallelogram linkage pivots about said first pivot point and said second pivot point through an angle of at least 180°.

5. The protective apparatus according to claim 1 wherein said parallelogram linkage includes a pair of generally horizontally extending, vertically spaced apart links each extending between said first pivot point and said second pivot point, and a distance between said first pivot point and said second pivot point on each of said links is greater than a vertical distance between said links.

6. The protective apparatus according to claim 1 including an arm attached to said railing and having a free end extending generally horizontally, a generally vertically extending support having a lower end for attachment to the threshold of the shaft door opening and an upper end, and a hinge link pivotally connected between said free end of said arm and said upper end of said support whereby said railing is stabilized in all positions of a pivotal movement between said two positions.

7. A protective railing assembly for a shaft door opening of an elevator shaft which, until a shaft door is installed in the shaft door opening, secures the shaft door opening against a falling of persons into the shaft comprising: a railing; a pair of parallelogram linkages attached to said railing at spaced apart first pivot points; and means for attaching said linkages to a threshold of an elevator shaft door opening at a pair of second pivot points spaced from said first pivot points whereby said railing is movable between two positions horizontally separated, a first one of said positions being closer to the shaft door opening than a second one of said positions by twice an amount of spacing between each said first pivot point and an associated one of said second pivot points.

8. The protective railing assembly according to claim 7 wherein said parallelogram linkages each include a pair of generally horizontally extending, vertically spaced apart links each extending between said first pivot point and said second pivot point, a distance between said first pivot point and said second pivot point on each of said links being greater than a vertical distance between said links, and said parallelogram linkage pivoting about said first pivot point and said second pivot point through an angle of at least 180°.

9. A protective railing assembly for a shaft door opening of an elevator shaft which, until a shaft door is installed in the shaft door opening; secures the shaft door opening against a failling of persons into the shaft comprising;

a railing;

a pair of spaced apart feet attached to said railing;

a pair of parallelogram linkages each pivotally attached to an associated one of said railing feet at a first pivot point; and means for attaching said linkages to a threshold of an elevator shaft door opening at a pair of second pivot points whereby said railing is movable between two positions horizontally separated, a first one of said positions being closer to the shaft door opening than a second one of said positions by twice an amount of spacing between each said first pivot point and an associated one of said second pivot points.

10. The protective railing assembly according to claim 9 wherein said railing includes an adjusting device for selectively varying a width of said railing to correspond to a desired door opening width.

11. The protective railing assembly according to claim 9 wherein each said parallelogram linkage includes a pair of generally horizontally extending, vertically spaced apart links each extending between said first pivot point and said second pivot point, and a distance between said first pivot point and said second pivot point on each of said links is greater than a vertical distance between said links.

12. The protective railing assembly according to claim 9 including a pair of arms attached to said railing and each having a free end extending generally horizontally, a pair of generally vertically extending supports each having a lower end for attachment to the threshold of the shaft door opening and an upper end, and a pair of hinge links each pivotally connected between said free end of one of said arms and said upper end of one of said supports whereby said railing is stabilized in all positions of a pivotal movement between said two positions.

* * * * *